US007485005B1

(12) United States Patent
Chi

(10) Patent No.: US 7,485,005 B1
(45) Date of Patent: Feb. 3, 2009

(54) ADAPTER CARD STRUCTURE

(75) Inventor: Hsueh-Jung Chi, Chung Ho (TW)

(73) Assignee: Jess-Link Products Co., Ltd., Taipei County (TW)

( * ) Notice: Subject to any disclaimer, the term of this patent is extended or adjusted under 35 U.S.C. 154(b) by 0 days.

(21) Appl. No.: 11/979,857

(22) Filed: Nov. 9, 2007

(51) Int. Cl.
*H01R 13/40* (2006.01)

(52) U.S. Cl. ..... 439/630; 439/507; 439/510

(58) Field of Classification Search ..... 439/188, 439/507, 510, 630, 945
See application file for complete search history.

(56) References Cited

U.S. PATENT DOCUMENTS 6,947,289 B2 * 9/2005 Nakanishi et al. ..... 361/737
7,326,086 B1 * 2/2008 Lee ..... 439/630
2004/0229511 A1 * 11/2004 Chen ..... 439/638

* cited by examiner

*Primary Examiner*—Tho D Ta
*Assistant Examiner*—Travis Chambers
(74) *Attorney, Agent, or Firm*—Rosenberg, Klein & Lee

(57) ABSTRACT

An adapter card structure includes a lower cover, an upper cover, an insulating plate, a terminal set and a slide switch. The upper cover covers the lower cover. The insulating plate is lodged between the upper cover and the lower cover. The terminal set comprises a plurality of terminals and an independent terminal. The terminals and the independent terminal are inserted into the insulating plate at intervals. A middle section of one of the terminals is connected with a middle section of the independent terminal to form a short circuit portion. A wave-shaped perpendicular plate is formed by means of bending and extending from the outermost one of the terminals. The slide switch is movably provided between the upper cover and the lower cover to engage with the wave-shaped plate. Via this arrangement, a user can have a clear click feeling when pushing the slide switch.

6 Claims, 5 Drawing Sheets

ADAPTER CARD STRUCTURE

BACKGROUND OF THE INVENTION

1. Field of the Invention

The present invention relates to an adapter card structure, and in particular to a data storage adapter card structure for connecting a data storage adapter card to another adapter card.

2. Description of Related Art

Conventional adapter cards are usually provided at one side of their casing with a slide switch. The side of the slide switch facing the casing is provided with a recess. The casing is provided with two protruding points to engage with the recess of the slide switch. The slide switch can be positioned at the two protruding points via the recess, so that the adapter card can be switched between a write enabled and write protected state.

However, the dimensions of such adapter cards are small, and thus the dimensions of the slide switch are even smaller. If the casing and the slide switch are molded including their protruding points and recess, respectively, the manufacture of the associated molds is difficult, and it is not easy to control the dimensions precisely. As a result, the protruding points and the recess may not correspond to each other very well, so that after operating the slide switch, a user cannot be sure whether the slide switch has been pushed to the correct position.

Therefore, in view of the above the drawbacks, the inventor proposes the present invention to overcome the above problems based on his deliberate research.

SUMMARY OF THE INVENTION

The object of the present invention is to provide an adapter card structure, in which one side of a terminal is formed with a wave-shaped plate, perpendicular to the plates of the other terminals, and a slide switch is provided to engage with the wave-shaped plate, so that the adapter card structure can be switched to a write protected and write enabled state according to the position of the slide switch along the wave-shaped plate.

In order to achieve the above object, the present invention provides an adapter card structure, which includes: a lower cover; an upper cover covering on the lower cover; an insulating plate between the upper cover and the lower cover; a terminal set comprising a plurality of terminals and an independent terminal, the terminals and the independent terminal being inserted into the insulating plate at intervals, a middle section of one of the terminals being connected with a middle section of the independent terminal to form a short circuit portion; a wave-shaped plate perpendicular to the other plates, the wave-shaped plate being formed by bending and extending the outermost one of the terminals; and a slide switch provided between the upper cover and the lower cover, the slide switch engaging with the wave-shaped plate.

The present invention has the following effect: A wave-shaped perpendicular plate is formed by bending and extending the outermost of the terminals. The wave-shaped plate is arranged to engage with the slide switch and has a better elasticity than the plastic protrusion used in the prior art, so that the user can feel a clearer click when pushing the slide switch, thereby understanding whether the slide switch has been pushed to a proper position or not. At the same time, the construction of the wave-shaped plate is simpler and easy to manufacture than plastic protrusions, thereby reducing the production cost.

Furthermore, the short circuit portion of the present invention is formed by means of using the material of the middle section of the terminal set, so that the material is used more efficiently and thus the waste material can be reduced. In order to further understand the characteristics and technical contents of the present invention, a detailed description related thereto will be explained with reference to the accompanying drawings. However, it should be understood that the drawings and the description are illustrative and not to be used to limit the scope of the present invention.

DETAILED DESCRIPTION OF THE PREFERRED EMBODIMENTS

Figure 1:
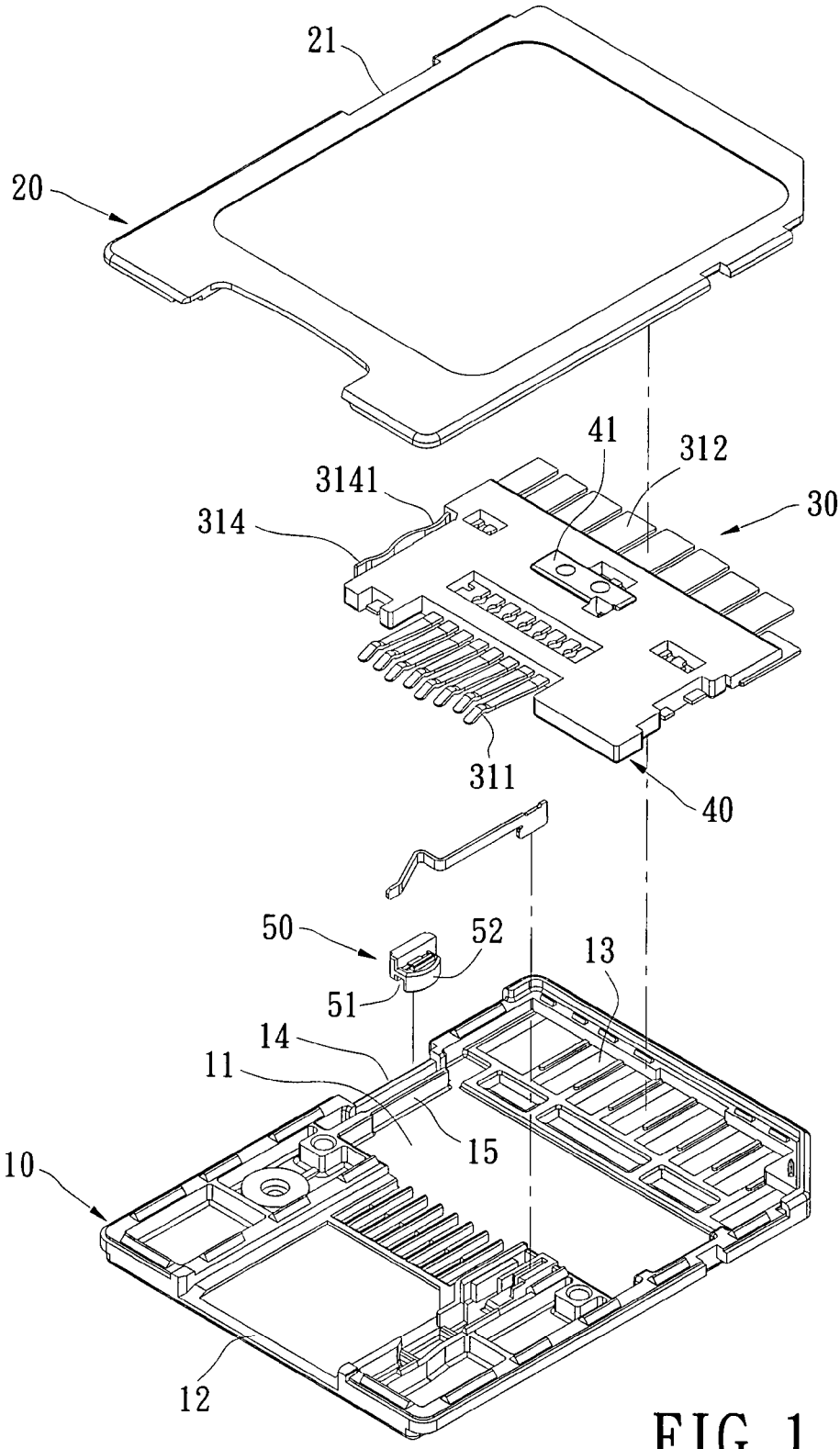
FIG. 1 is an exploded perspective view of the present invention.
Figure 2:
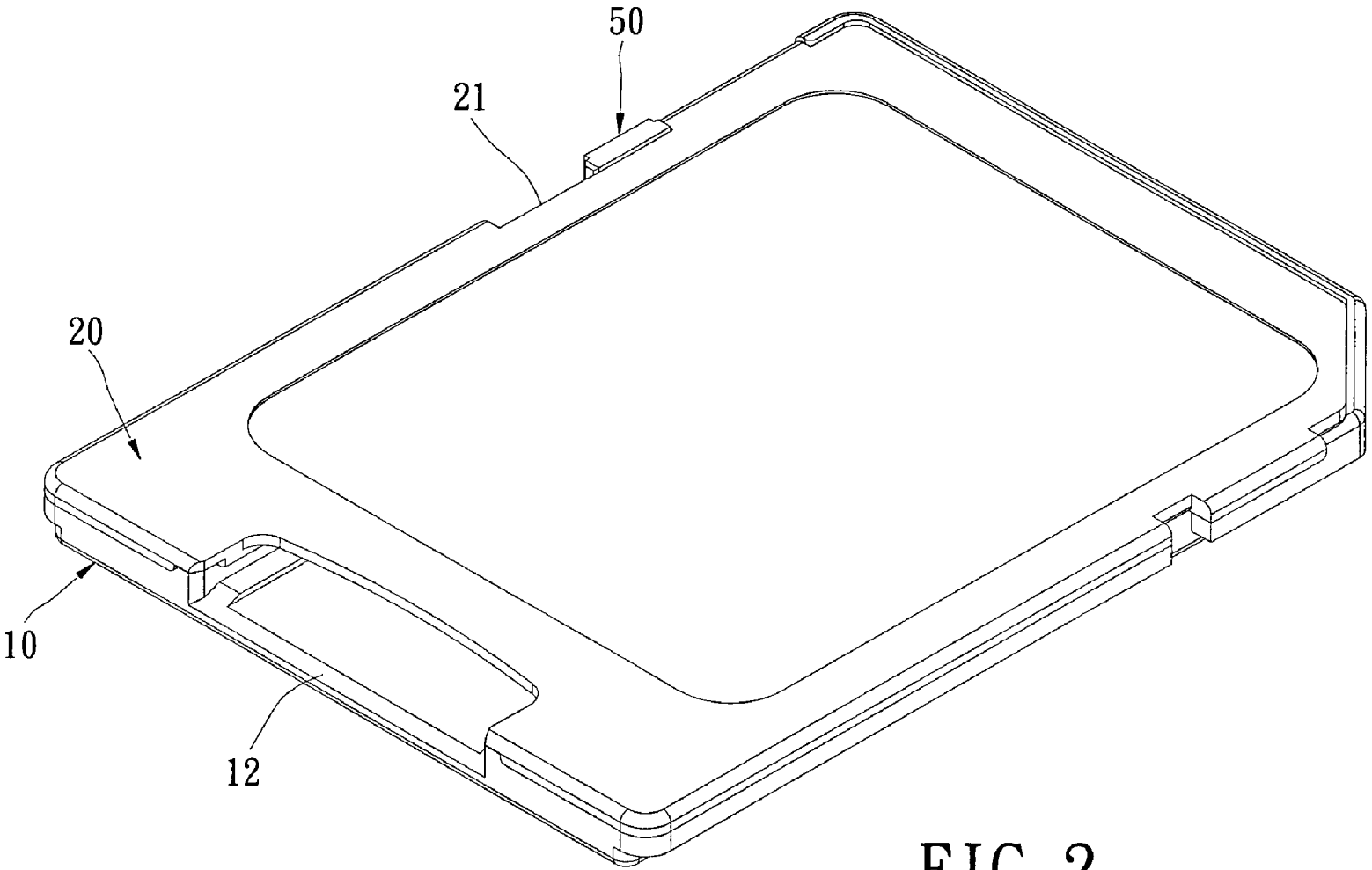
FIG. 2 is an assembled perspective view of the present invention.

Please refer to FIGS. 1 to 4. The adapter card structure of the present invention includes a lower cover 10, an upper cover 20, a terminal set 30, an insulating plate 40 and a slide switch 50.

The lower cover 10 is made of insulating plastic materials. The lower cover 10 is provided with a cavity 11 at a position near the center thereof to accommodate an adapter card. The front end of the lower cover 10 is provided with an insertion port 12 for allowing an adapter card (not shown) to be inserted therein. The rear end of the lower cover 10 is provided with a plurality of openings 13. The left side of the lower cover 10 is provided with a notch 14. The bottom surface of the cavity 11 is provided with a rib 15 at a position adjacent to the notch 14.

The upper cover 20 is made of insulating plastic materials and covers the lower cover 10. The left side of the upper cover 20 is provided with a notch 21 to correspond to notch 14 of the lower cover 10.

Figure 3:
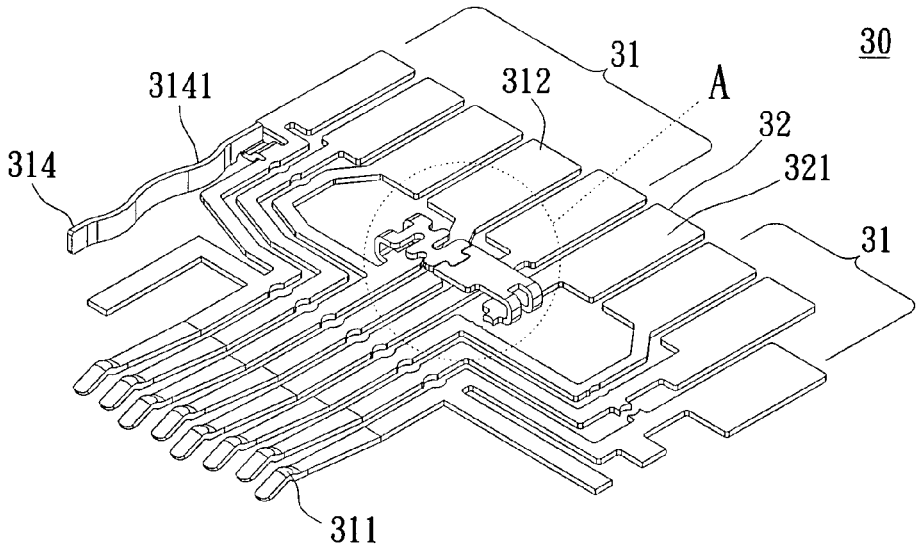
FIG. 3 is a perspective view showing the terminal set of the present invention.

The terminal set 30 is made of a metallic material that has electric conductivity and elasticity. The terminal set comprises a plurality of terminals 31 and an independent terminal 32 (please also refer to FIG. 3). The front and rear ends of each terminal 31 are formed with a contacting portion 311 and a pin portion 312 respectively. The contacting portions 311 correspond to the contacts of the adapter card. With reference to FIG. 3, the independent terminal 32 is disposed between the terminals 31. The rear end of the independent terminal 32 is formed with pin portion 321.

Figure 4:
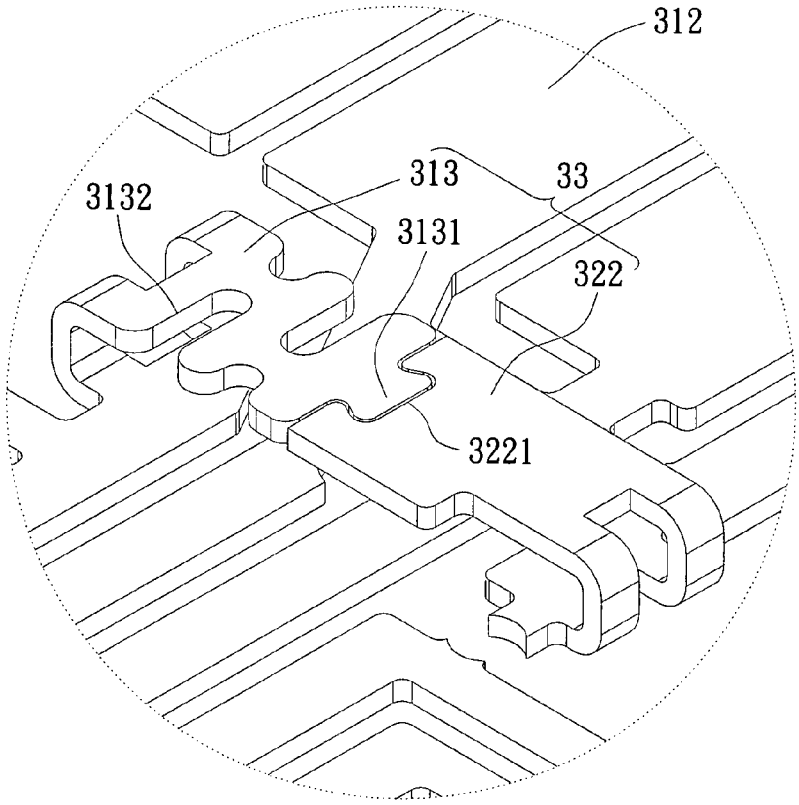
FIG. 4 is an enlarged view of the portion A in FIG. 3.

Please refer to FIG. 4. The central position of the terminal set 30 is further provided with a short circuit portion 33. The short circuit portion 33 comprises a first bridging portion 313 and a second bridging portion 322 connected with the first bridging portion 313. The first bridging portion 313 is formed by means of integrally bending and extending the middle section of one of the terminals 31. In the present embodiment, the third terminal 31 from the left side is used to form the first bridging portion 313, but the present invention is not limited thereto. The distal end of the first bridging portion 313 is provided with a dovetail-like first docking portion 3131. The two lateral sides of the first bridging portion 313 are formed with a plurality of grooves 3132, thereby allowing the first bridging portion 313 to move with respect to the second bridging portion 322.

The second bridging portion 322 is formed by means of integrally bending and extending the middle section of independent terminal 32. The distal end of the second bridging portion 322 is provided with a dovetail-like second docking portion 3221. The second docking portion 3221 is engaged with the first docking portion 3131 of the first bridging portion 313, so that the first bridging portion 313 and second bridging portion 322 are connected to each other. In this way, the terminal 31 and the independent terminal 32 can form a short circuit.

The left side of the terminal set 30 is provided with a wave-shaped plate 314 perpendicular to the other plates. The wave-shaped plate 314 is integrally formed by bending upwardly and extending the leftmost one of the terminals 31. One end of the wave-shaped plate 314 is connected to the middle section of the outermost terminal 31, and the other end is a free end. Via this arrangement, the wave-shaped plate 314 has good elasticity. The wave-shaped plate 314 is formed with two concave surfaces 3141 that are arranged at an interval and adjacent to one side of the notch 14 of the lower cover 10. However, the number of the concave surface 3141 is not limited thereto, and can be varied according to the demands.

The insulating plate 40 is made of insulating materials and is lodged in the cavity 11 of the lower cover 10 (please also refer to FIG. 1). The terminals 31 and the independent terminal 32 are inserted onto the insulating plate 40 by means of an insert-molding process. Further, the contacting portions 311 and the pin portions 312 of the terminals 31 protrude from the front and rear ends of the insulating plate 40. The coverage by insulating plate 40 leads to a gap formed between the terminals 31 and the independent terminal 32, so that the terminals are not brought into contact with each other. The insulating plate 40 is provided with a cavity (not shown) for accommodating the short circuit portion 33. A cover 41 covers cavity 11 so as to protect the short circuit portion 33.

The slide switch 50 is made of insulating materials. The user can push the slide switch to switch between write enable and write protected mode. The bottom of the slide switch 50 has a guiding notch 51 (please also refer to FIG. 1). The guiding notch 51 corresponds to a side wall of notch 14 of the lower cover 10. Adjacent to one side of insulating plate 40, the slide switch 50 is formed with a convex surface 52 to correspond to the concave surface 3141 of the wave-shaped plate 314.

Figure 5:
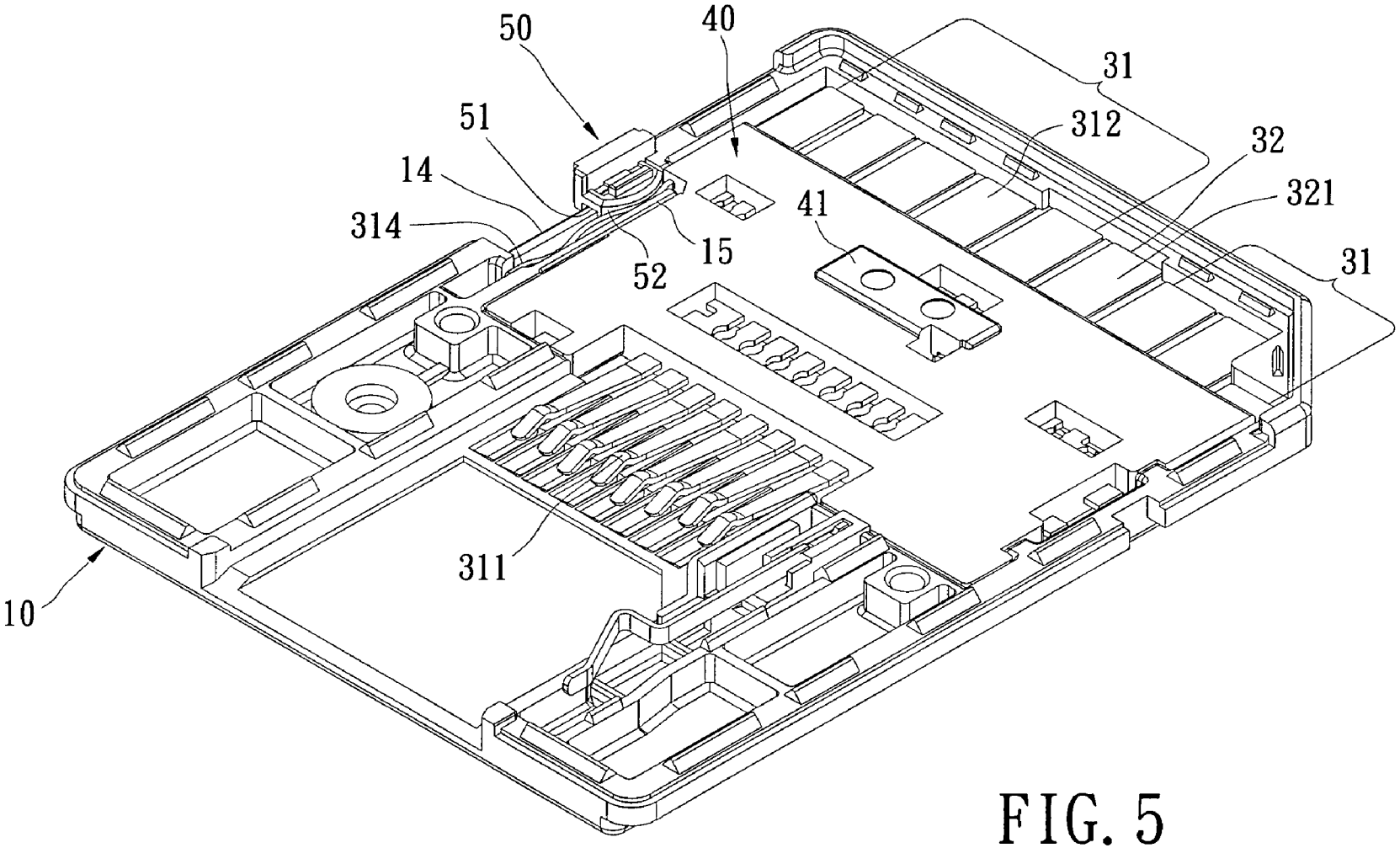
FIG. 5 is an assembled perspective view of the present invention, in which the upper cover is removed.
Figure 6:
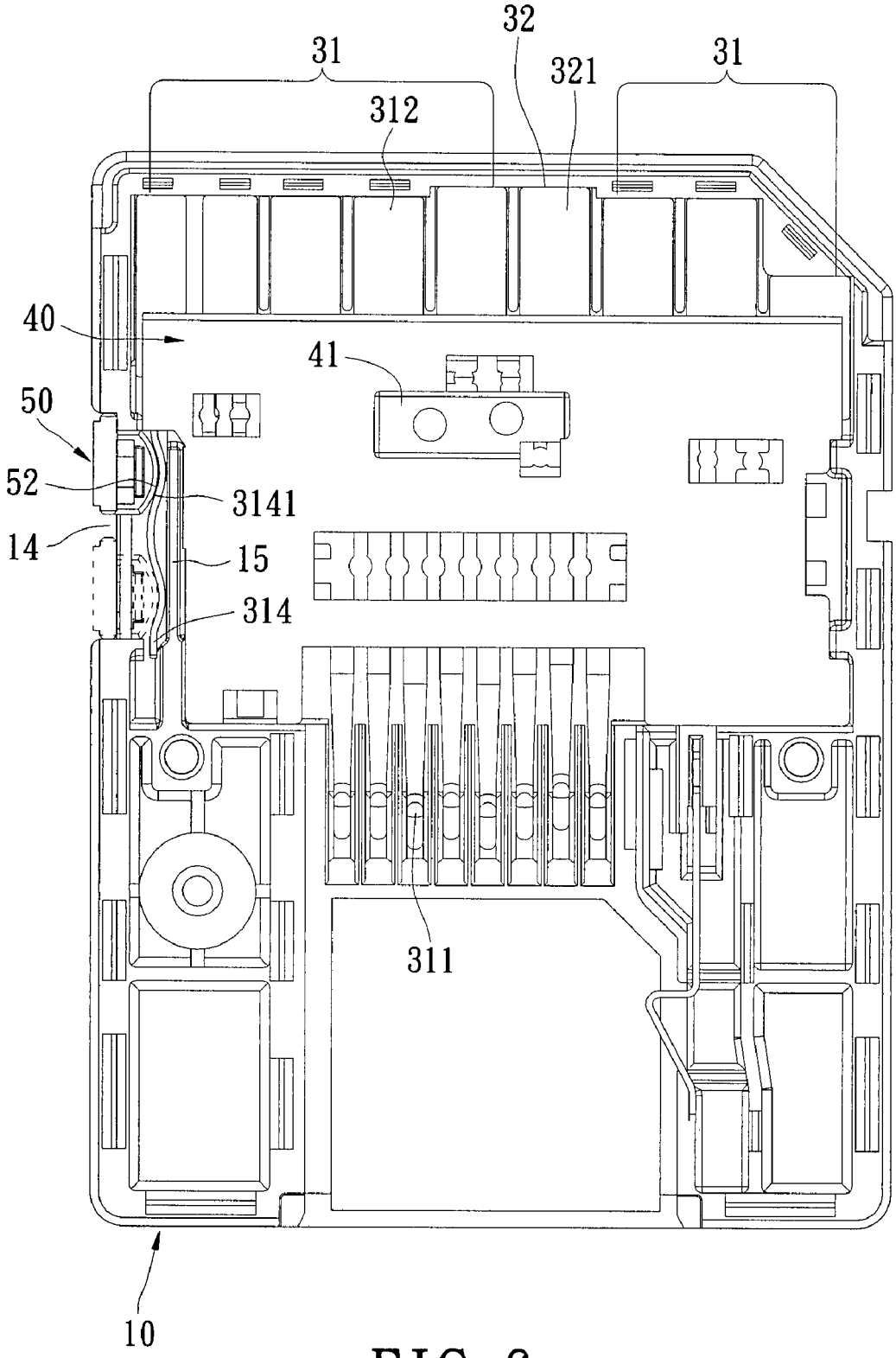
FIG. 6 is a top view of the present invention, in which the upper cover is removed.

Please refer to FIGS. 5 and 6. Upon assembly of the present invention, the terminal set 30 and the insulating plate 40 are received between the upper cover 20 and the lower cover 10 (the upper cover 20 is not shown in these figures). The contacting portions 311 of terminals 31 are brought into contact with the respecting contacts of the adapter card that is inserted into the insertion port 12, thereby achieving an electrical connection. The pin portions 312 of the terminals 31 are exposed to the plurality of openings 13 of the lower cover 10 (please also refer to FIG. 1), thereby electrically connecting to the corresponding terminals (not shown) of an adapter card. Similarly, the pin portion 321 of the independent terminal 32 is exposed to the corresponding opening 13 of the lower cover 10, and is arranged in parallel to the pin portions 312 of the terminals 31. The wave-shaped plate 314 is arranged adjacent to the rib 15 of the lower cover 10. The rib 15 can provide a supporting force for the wave-shaped plate 314, thereby increasing the strength in structure.

The slide switch 50 is lodged between notch 21 of the upper cover 20 and notch 14 of the lower cover 10, and straddles the side wall of notch 14 of the lower cover 10 via the guiding notch 51. In this way, the slide switch 50 can be movably installed between the upper cover 20 and the lower cover 10. The convex surface 52 of the slide switch 50 abuts against a concave surface 3141 on one side of the wave-shaped plate 314. Via this arrangement, the slide switch 50 engages with the wave-shaped plate 314 to secure a write protected switching state. The slide switch 50 can be pushed by a user and thus be positioned in the two concave surfaces 3141, thereby generating a clear click feeling. Therefore, the adapter card structure can be switched between the write enable and write protect function.

According to the above, in the adapter card structure of the present invention, a wave-shaped perpendicular plate 314 is formed by means of integrally extending from the outermost terminal 31, so that the wave-shaped plate 314 can be formed more easily by a pressing process. Further, one side of the slide switch 50 has a convex surface 52 to engage with the wave-shaped plate 314, thereby simplifying the mold structure for manufacturing the slide switch 50 and thus reducing the production cost. The slide switch 50 can generate a clear click feeling along the wave-shaped plate 314, so that the user can understand whether the slide switch 50 has been pushed into a proper position or not. With the gentle engagement of the convex surface 52 of the slide switch 50 with the wave-shaped plate 314, the user can push the slide switch 50 smoothly without applying a large force, thereby switching the adapter card structure between the write enable and write protect function.

Further, in the present invention, the middle sections of terminal 31 and the independent terminal 32 are bent to form the two bridging portions 313, 3222. The two bridging portions 313, 322 are connected to form the short circuit portion 33. Thus, it is unnecessary to reserve additional material at the rear end of the terminal set 30, thereby reducing the area of the material sheet for pressing the terminal set 30. Therefore, waste material and in turn the production cost can be reduced.

Further, the first bridging portion 313 can move with respect to the second bridging portion 322 by means of the plurality of grooves 3132 on both sides thereof. Therefore, even if the first bridging portion 313 is not aligned with the second bridging portion 322 due to a production error, the movability of the first bridging portion 313 can still compensate for a dimensional error. Thus, the two bridging portions 313 and 322 can still be connected.

Although the present invention has been described with reference to the foregoing preferred embodiment, it will be understood that the invention is not limited to the details thereof. Various equivalent variations and modifications may occur to those skilled in the art in view of the teachings of the present invention. Thus, all such variations and equivalent modifications are embraced within the scope of the invention as defined in the appended claims.

What is claimed is:

1. An adapter card structure, comprising:

a lower cover;

an upper cover for covering on the lower cover;

an insulating plate between the upper cover and the lower cover;

a terminal set comprising a plurality of terminals and an independent terminal, the terminals and the independent terminal being inserted into the insulating plate at intervals, a middle section of one of the terminals being connected with a middle section of the independent terminal to form a short circuit portion, the short circuit portion including a first bridging portion and a second bridging portion, the first bridging portion being formed by bending and extending the middle section of one of the terminals, the second bridging portion being formed by bending and extending the middle section of the independent terminal, and the first bridging portion being connected to the second bridging portion;

a wave-shaped perpendicular plate, the wave-shaped plate being formed by bending and extending the outermost one of the terminals; and a slide switch provided between the upper cover and the lower cover, the slide switch engaging with the wave-shaped plate.

2. The adapter card structure according to claim 1, wherein a distal end of the first bridging portion is provided with a first docking portion, a distal end of the second bridging portion is provided with a second docking portion, and the second docking portion is engaged with the first docking portion.

3. The adapter card structure according to claim 1, wherein two lateral sides of the first bridging portion are provided with a plurality of grooves.

4. The adapter card structure according to claim 1, wherein the slide switch is formed with a convex surface adjacent to one side of the insulating plate, and the convex surface abuts against one side of the wave-shaped plate.

5. The adapter card structure according to claim 4, wherein one side of the wave-shaped plate is formed with at least one concave surface, and the convex surface of the slide switch abuts against the concave surface of the wave-shaped plate.

6. An adapter card structure, comprising:

a lower cover;

an upper cover for covering on the lower cover;

an insulating plate between the upper cover and the lower cover;

a terminal set comprising a plurality of terminals and an independent terminal, the terminals and the independent terminal being inserted into the insulating plate at intervals, a middle section of one of the terminals being connected with a middle section of the independent terminal to form a short circuit portion;

a wave-shaped perpendicular plate, the wave-shaped plate being formed by bending and extending the outermost one of the terminals, one end of the wave-shaped plate being connected to the middle section of the outermost one of the terminals, and the other end of the wave-shaped plate being a free end; and a slide switch provided between the upper cover and the lower cover, the slide switch engaging with the wave-shaped plate.

* * * * *